US008043444B2

(12) United States Patent
Yoshihara

(10) Patent No.: US 8,043,444 B2
(45) Date of Patent: Oct. 25, 2011

(54) STEEL WIRE FOR COLD-FORMED SPRING EXCELLENT IN CORROSION RESISTANCE AND METHOD FOR PRODUCING THE SAME

(75) Inventor: Nao Yoshihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 612 days.

(21) Appl. No.: 11/276,842

(22) Filed: Mar. 16, 2006

(65) Prior Publication Data

US 2006/0225819 A1 Oct. 12, 2006

(30) Foreign Application Priority Data

Apr. 11, 2005 (JP) ..... 2005-113476

(51) Int. Cl.

| | |
|---|---|
| ***C22C 38/34*** | (2006.01) |
| ***C22C 38/26*** | (2006.01) |
| ***C22C 38/28*** | (2006.01) |
| ***C22C 38/40*** | (2006.01) |
| ***C21D 9/52*** | (2006.01) |
| ***C21D 8/00*** | (2006.01) |

(52) U.S. Cl. ..... 148/333; 148/334; 148/335; 148/908; 148/568; 148/595; 148/598; 148/599; 148/580

(58) Field of Classification Search ..... 148/333–335, 148/908, 568, 595, 598, 599, 580
See application file for complete search history.

(56) References Cited

U.S. PATENT DOCUMENTS

| | | | |
|---|---|---|---|
| 4,770,721 | A | 9/1988 | Yamamoto et al. |
| 5,508,002 | A | 4/1996 | Kawaguchi et al. |
| 5,776,267 | A | 7/1998 | Nanba et al. |
| 5,846,344 | A | 12/1998 | Kawaguchi et al. |
| 6,338,763 | B1 | 1/2002 | Hashimura et al. |
| 2003/0201036 | A1 | 10/2003 | Hashimura et al. |

FOREIGN PATENT DOCUMENTS

EP 1 619 264 A1 1/2006

(Continued)

OTHER PUBLICATIONS

Computer-generated English translation of Japanese patent 2004-143482, Hagiwara Hiroshi, May 20, 2004.*
U.S. Appl. No. 11/559,654, filed Nov. 14, 2006, Yoshihara.

(Continued)

*Primary Examiner* — Deborah Yee
(74) *Attorney, Agent, or Firm* — Oblon, Spivak, McClelland, Maier & Neustadt, L.L.P.

(57) ABSTRACT

A steel wire for a cold-formed spring according to the present invention contains a prescribed chemical component composition, wherein: a martensitic transformation start temperature $M_{S1}$ shown by the following expression (1) is in the range from 280° C. to 380° C.; the austenite grain size number N of austenite grains is No. 12 or more; the grain boundary share of carbide precipitated along the austenite grain boundaries is 50% or less; the amount of retained austenite after austenitized and tempered is 20 vol. % or less; and the tensile strength is 2,000 MPa or more;

$$M_{S1}=550-361[C]-39[Mn]-20[Cr] \quad (1),$$

where [C], [Mn] and [Cr] represent the contents (mass %) of C, Mn and Cr, respectively. Such a steel wire can: secure hot-rolling formability and subsequent drawability while aiming at higher strength and higher stress; moreover exhibit excellent corrosion resistance; and obtain a spring (mainly a suspension spring for an automobile) excellent also in fatigue strength which is a basic required characteristic.

12 Claims, 4 Drawing Sheets

FOREIGN PATENT DOCUMENTS

| | | |
|---|---|---|
| JP | 5-320827 | 12/1993 |
| JP | 2001-247934 | 9/2001 |
| JP | 2002-180198 | 6/2002 |
| JP | 2003-105498 | 4/2003 |
| JP | 3429258 | 5/2003 |
| JP | 2004-143482 | 5/2004 |

OTHER PUBLICATIONS

U.S. Appl. No. 11/348,409, filed Feb. 7, 2006, Kochi, et al.
U.S. Appl. No. 11/583,703, filed Oct. 4, 2006, Yoshihara.
U.S. Appl. No. 11/548,080, filed Oct. 10, 2006, Yoshihara, et al.
U.S. Appl. No. 12/097,313, filed Jul. 18, 2008, Yoshihara, et al.

* cited by examiner

STEEL WIRE FOR COLD-FORMED SPRING EXCELLENT IN CORROSION RESISTANCE AND METHOD FOR PRODUCING THE SAME

BACKGROUND OF THE INVENTION (i) Field of the Invention

The present invention relates to: a steel wire for a spring useful as a material for a cold-formed spring used as a suspension spring for an automobile or the like, in particular a steel wire for a spring having both the air-durability and corrosion resistance which are considered to be important characteristics of a spring; and a method useful for producing the steel wire for a spring.

(ii) Description of the Related Art

A cold-formed spring is mainly used as a suspension spring for an automobile and the chemical compositions of steels for springs used as the materials for the springs are stipulated by JIS G3565 to G3567, G4801 and others. In the event of producing a cold-formed spring from such a steel for a spring, a hot-rolled wire rod produced from such a steel for a spring is drawn to a prescribed wire diameter, thus a steel wire is produced and thereafter subjected to oil tempering treatment (austenitizing and tempering treatment), and successively the steel wire is cold-formed into a spring.

A cold-formed spring produced as stated above is required to reduce the size and weight thereof for the reduction of fuel consumption and, as a part of the requirement, a spring of a higher stress is desired and a high-strength steel wire for a spring of 2,000 MPa or more in tensile strength after austenitized and tempered is demanded. In general however, the defect susceptibility of a spring tends to increase as the strength thereof increases and, in the case of a suspension spring used under a corrosive environment in particular, the corrosion fatigue life deteriorates and thus there is fear that breakage occurs at an early stage. It is estimated that the corrosion fatigue life deteriorates because corrosion pits on a surface act as the origins of stress concentration and the generation and propagation of fatigue cracks are accelerated. Therefore, excellent corrosion resistance is a characteristic important for a suspension spring.

In order to adapt to the requirement of higher stress as stated above, various technologies have been studied. As such a means, a method of lowering the tempering temperature at oil tempering treatment (for example, about 400° C.) and thus increasing tensile strength has sometimes been adopted. However, by the method, the toughness and ductility of a steel wire lower, breakage and cracks of the spring material wire are caused during cold-forming, and spring formability is hindered. Further, even when the C content in a steel for a spring is increased and thus tensile strength is increased, still not only toughness and ductility deteriorate and thus spring formability is hindered but also corrosion resistance deteriorates, and the quality as a suspension spring for an automobile cannot be secured.

In contrast, a means of adding great amounts of alloying elements such as Ni, Cu, Cr, Si, etc. and thus improving corrosion resistance is also considered. However, when such a means is adopted, not only the cost of a steel material increases, but also the hardenability of the steel increases, thereby the proportion of martensite and bainite structures in the structure after hot-rolling increases, resultantly toughness and ductility are lowered, and drawbacks such as breakage of the wire during subsequent cold-drawing are caused.

As stated above, to realize a steel wire having both the characteristics of high tensile strength and good corrosion resistance is in a difficult situation at the present day. Then, various technologies have been proposed in order to improve such problems. For example, U.S. Pat. Nos. 5,508,002 and 5,846,344 propose a means of: controlling the combination of components so that an FP value stipulated by the following expression (5) may be in the range from 2.5 to 4.5; thereby inhibiting martensite and bainite structures after hot-rolling; and resultantly inhibiting the deterioration of formability caused by the addition of alloying elements. Such a means is a technology which: is based on the addition of alloying elements which improve corrosion resistance; and further improves the corrosion resistance by reforming the austenitized and tempered structure. However, the improvement of corrosion resistance by the technology is limited.

$$FP=(0.23[C]+0.1)\times(0.7[Si]+1)\times(3.5[Mn]+1)\times(2.2[Cr]+1)\times(0.4[Ni]+1)\times(3[Mo]+1) \quad (5),$$

where [C], [Si], [Mn], [Cr], [Ni] and [Mo] represent the contents (mass %) of C, Si, Mn, Cr, Ni and Mo, respectively.

Further, Japanese Patent No. 3429258 discloses a means of attaining both high tensile strength and good corrosion resistance by controlling the content of Cr to 0.25% or less and further controlling the contents of Cr, Cu and Ni so as to satisfy the relationship stipulated by the following expression (6). However, even by the technology, steel material component design has to be carried out within a regulated range of chemical component compositions and thus the improvement of corrosion resistance is limited.

$$[Cr]\leqq([Cu]+[Ni])/2 \quad (6),$$

where [Cr], [Cu] and [Ni] represent the contents (mass %) of Cr, Cu and Ni, respectively.

Furthermore, U.S. Pat. No. 6,338,763 proposes a technology of improving formability by controlling the amount of retained austenite (retained γ) to 6 vol. % or less and thus reducing the induced transformation of the retained austenite during the cold-forming of a spring. However, the technology is basically aimed at the improvement of formability and does not take the improvement of corrosion resistance into consideration at all.

In the meantime, it is known that a method of fining austenite grains is also useful as a means for inhibiting the deterioration of toughness, ductility and resistance to hydrogen embrittlement accompanying the increase of the strength of a steel for a spring. As such a means for example, U.S. Pat. No. 5,776,267 discloses a method for fractionizing the sizes and structures of carbide and nitride in order to improve resistance to hydrogen embrittlement. However, even when the technology is adopted, the size of austenite grains is limited to No. 11 in austenite grain size number and the improvement of corrosion resistance is limited accordingly.

SUMMARY OF THE INVENTION

The present invention is established in order to solve the aforementioned problems of prior art and the object thereof is to provide: a steel wire for a cold-formed spring which can secure hot-rolling formability and subsequent drawability while aiming at higher strength and higher stress, moreover exhibit excellent corrosion resistance, and obtain a spring (mainly a suspension spring for an automobile) excellent also in fatigue strength which is a basic required characteristic; and a method useful for producing the steel wire.

In one aspect of the present invention, a steel wire for a cold-formed spring, which has attained the aforementioned object, contains C: 0.45-0.65% (mass %, the same is applied hereunder), Si: 1.30-2.5%, Mn: 0.05-0.9% and Cr: 0.05-2.0%, wherein: P and S are controlled to 0.020% or less (including 0%), respectively; a martensitic transformation start temperature $M_{S1}$ shown by the following expression (1) is in the range from 280° C. to 380° C.; the austenite grain size number N of austenite grains (hereunder referred to as "prior austenite austenite grain size number N") is No. 12 or more; the grain boundary share of carbide precipitated along the austenite grain boundaries is 50% or less; the amount of retained austenite after austenitized (quenched) and tempered is 20 vol. % or less; and the tensile strength is 2,000 MPa or more;

$$M_{S1}=550-361\,[C]-39[Mn]-20[Cr] \quad (1),$$

where [C], [Mn] and [Cr] represent the contents (mass %) of C, Mn and Cr, respectively.

In another aspect of the present invention, it is also effective that a steel wire for a cold-formed spring, if necessary, further contains (a) at least one kind selected from among the group of Nb: 0.01-0.10%, V: 0.07-0.40% and Mo: 0.10-1.0%, (b) at least one kind selected from among the group of Ni: 0.05-1.0%, Cu: 0.05-1.0% and W: 0.10-1.0%, (c) Ti: 0.01 to 0.1%, and other elements, and the characteristics of the steel wire for a spring are improved in accordance with the kinds of contained elements.

When the elements of above (a) and/or (b) are contained in particular, since some elements affect the transformation start temperature $M_S$ of martensite, it is necessary to control any of the values $M_{S2}$ to $M_{S4}$ calculated with any of the following expressions (2) to (4) so as to be in the range from 280° C. to 380° C. in consideration of the contents of those elements;

$$M_{S2}=550-361[C]-39[Mn]-20[Cr]-35[V]-5[Mo] \quad (2),$$

$$M_{S3}=550-361[C]-39[Mn]-20[Cr]-17[Ni]-10[Cu]-5[W] \quad (3)$$

$$M_{S4}=550-361[C]-39[Mn]-20[Cr]-35[V]-5[Mo]-17[Ni]-10[Cu]-5[W] \quad (4),$$

where, in the above expressions (2) to (4), [C], [Mn], [Cr], [V], [Mo], [Ni], [Cu] and [W] represent the contents (mass %) of C, Mn, Cr, V, Mo, Ni, Cu and W, respectively.

In still another aspect according to the present invention, when a steel wire for a cold-formed spring is produced, it is only necessary to adopt a production method comprising the processes of: hot-rolling a steel having an aforementioned chemical component composition into a shape of a wire rod; cooling the hot-rolled wire rod steel from the austenitizing temperature range, and thereby controlling the fraction of ferrite and pearlite structures to 40% or more in area percentage and the fraction of a structure comprising martensite and bainite to 60% or less in area percentage; applying cold-drawing to the steel having the structures of aforementioned fractions at a reduction of area of 20% or more; and applying austenitizing (quenching) and tempering to the steel subjected to the cold-drawing, wherein the steel is heated to a prescribed temperature at a heating rate of 50° C./sec. or higher and thereafter retained for 90 sec. or less at the prescribed temperature in the austenitizing process and heated to a tempering temperature in the range from 410° C. to 480° C. at a heating rate of 50° C./sec. or higher and thereafter retained for 60 sec. or less at the tempering temperature in the tempering process. In the production method, it is preferable that oil and water or only water are/is used as a cooling medium in the austenitizing process.

A steel wire for a cold-formed spring according to the aspects of the present invention, which can secure hot-rolling formability and subsequent drawability, moreover exhibit excellent corrosion resistance, and obtain a spring excellent also in fatigue strength which is a basic required characteristic even when the tensile strength is 2,000 MPa or more, can be realized by controlling: a chemical component composition adequately; martensitic transformation start temperatures $M_{S1}$ to $M_{S4}$ stipulated by prescribed relational expressions in the range from 280° C. to 380° C.; an austenite grain size number N to No. 12 or more; the grain boundary share of carbide precipitated along the austenite grain boundaries to 50% or less; and the amount of retained austenite after austenitized and tempered to 20 vol. % or less. A spring produced by using a steel wire for a spring obtained through above processes is very useful mainly as a suspension spring for an automobile.

These and other objects, features, and other advantages of the invention will be apparent from the following more particular description of preferred embodiments of the invention, as illustrated in the accompanying drawings.

BRIEF DESCRIPTION OF THE DRAWINGS

In the accompanying drawings

DETAILED DESCRIPTION OF THE INVENTION

Figure 1:
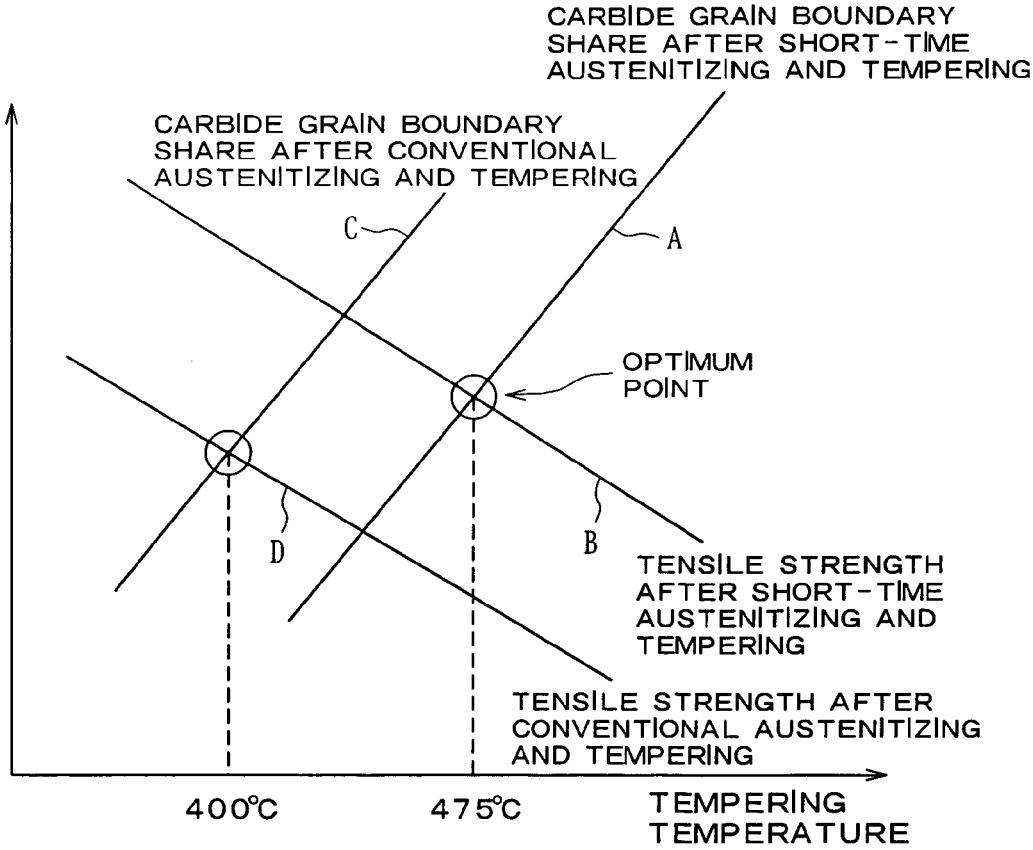
FIG. 1 is a schematic graph explaining the difference between conventional austenitizing and tempering conditions and the austenitizing and tempering conditions according to the present invention.

The present inventors have carried out studies from various angles in order to attain the aforementioned object. As a result, the findings shown in the following items (a) to (f) are obtained:

(a) it is possible to: suppress the deterioration of toughness and ductility caused by the increase of strength; and moreover improve corrosion resistance, by fractionizing prior austenite crystal grains to a substantially larger degree than ever before;

(b) it is possible to obtain very fine austenite grains while promoting dissolution of carbide even in austenitizing at a high heating rate of 50° C./sec. or higher, by applying drawing at a reduction of area of 20% or more and thus introducing strain dislocation;

(c) it is effective to: lower a heating temperature at austenitizing; increase a heating rate; and shorten a heating time, in order to avoid growing austenite grains which have been fined by the means of above item (b) during the austenitization heating and keep the crystal grains fine during the time from the austenitization heating to cooling;

(d) it is possible to: control the reduction of area to 20% or more at drawing; and thus adopt the means of above item (b), by suppressing martensite and bainite in a structure before austenitizing (after hot-rolling and before drawing) to some extent and restricting the lower limit of the fraction of ferrite and pearlite;

(e) it is possible to: set a martensitic transformation start temperature at a higher level by regulating alloying elements; suppress the amount of retained austenite; suppress the amount of film-like and granular carbide precipitated by the decomposition of retained austenite during tempering; and improve corrosion resistance; and (f) it is possible to: lower an austenitizing temperature by adopting water as the cooling medium; reduce the amount of retained austenite by lowering the transformation finish temperature of a steel material (the lowest temperature); thereby suppress the precipitation of film-like cementite and granular carbide caused by the decomposition of retained austenite during tempering; and improve corrosion resistance.

Then, the present inventors: have further carried out studies on the basis of the above findings; have resultantly found that it is possible to obtain a steel wire for a cold-formed spring which can realize a spring capable of exhibiting excellent corrosion resistance without deteriorating toughness and ductility by appropriately regulating the chemical component composition of the steel material, further stipulating the martensitic transformation start temperatures $M_{S1}$ to $M_{S4}$ of the steel material, the austenite grain size number N, the grain boundary share of carbide precipitated along the austenite grain boundaries, the amount of retained austenite after austenitized and tempered, and others in appropriate ranges, and thereby utilizing the combined effect of the fractionization of austenite grains and the suppression of the precipitation of film-like and granular carbide; and thus have established the present invention.

In a steel wire for a cold-formed spring according to the present invention, the chemical component composition thereof has to be stipulated adequately and the reasons for limiting the ranges of the components (basic components C, Si, Mn, Cr, P and S) are as follows.

[C: 0.45 to 0.65%]

C is an element which contributes to the increase of strength (hardness) after austenitized and tempered. Then, when a C content is less than 0.45%, the hardness after austenitized and tempered is insufficient and, on the other hand, when it exceeds 0.65%, not only the toughness and ductility after austenitized and tempered deteriorate but also the corrosion resistance is badly affected and moreover the reduction of retained austenite amount is hardly secured. For those reasons, a C content has to be controlled to 0.45 to 0.65%. Further, a preferable C content is in the range from 0.47 to 0.54% in consideration of the strength and toughness as a spring steel.

[Si: 1.3 to 2.5%]

Si is an element which contributes to the increase of strength as a solid solution hardening element. When a Si content is less than 1.3%, the strength of a matrix tends to be insufficient. However, when Si is contained in excess of 2.5%, the dissolution of carbide is insufficient during austenitization heating. Hence, in order to austenitize uniformly, a higher heating temperature is required, resultantly the decarburization of a surface progresses, and the air-durability of a spring deteriorates. For those reasons, a Si content has to be controlled to 1.3 to 2.5%. Further, a preferable Si content is in the range from 1.8 to 2.1% from the viewpoint of the strength and hardness and the suppression of decarburization as a spring material.

[Mn: 0.05 to 0.9%]

Mn is an element effective in enhancing hardenability of a steel material and, in order to exhibit the effect, a Mn content of 0.05% or more is necessary. However, when a Mn content is excessive, hardenability becomes excessive, a supercooled structure is likely to be formed, and the effect of the reduction of the retained austenite amount is hardly secured. Hence, the upper limit of a Mn content is set at 0.9%. Note that, since Mn has a possibility of forming MnS which acts as the origin of fracture, it is desirable to control MnS so as not to be formed to the utmost by the reduction of a S content or the combination with other sulfide-forming elements (Cu and others).

[Cr: 0.05 to 2.0%]

Cr is an element which makes rust formed on a surface layer under corrosive conditions amorphous and dense, contributes to the improvement of corrosion resistance, and effectively acts on the improvement of hardenability in the same way as Mn. In order to exhibit the effects, it is necessary to contain Cr by 0.05% or more. However, when a Cr content is excessive and exceeds 2.0%, carbide is hardly dissolved during austenitizing and an intended tensile strength cannot be secured and moreover the effect of the present invention in reducing a retained austenite amount is hardly obtained. A preferable lower limit of a Cr content is 0.1% and a preferable upper limit thereof is 1.4%.

[P: 0.020% or Less (Including 0%)]

P segregates at austenite grain boundaries, embrittles the grain boundaries, and deteriorates resistance to delayed fracture. Hence it is necessary to suppress a P content to the utmost and the upper limit of a P content is set at 0.020% from the viewpoint of industrial production.

[S: 0.020% or Less (Including 0%)]

S, like P, segregates at austenite grain boundaries, embrittles the grain boundaries, and deteriorates resistance to delayed fracture. Hence it is necessary to suppress a S content to the utmost and the upper limit of a S content is set at 0.020% from the viewpoint of industrial production.

The basic components of a steel wire according to the present invention are as stated above and the balance consists of Fe and unavoidable impurities. However, it is also effective, if necessary, to further contain (a) at least one kind selected from among the group of Nb: 0.01-0.10%, V: 0.07-0.40% and Mo: 0.10-1.0%, (b) at least one kind selected from among the group of W: 0.10-1.0%, Ni: 0.05-1.0% and Cu: 0.05-1.0%, (c) Ti: 0.01 to 0.10%, and other elements, and the characteristics of the steel wire for a spring are improved in accordance with the kinds of contained elements. The reasons for limiting the ranges of the components when they are added are as follows.

[At Least One Kind Selected from Among the Group of Nb: 0.01-0.10%, V: 0.07-0.40% and Mo: 0.10-1.0%]

Those elements are effective in enhancing the hydrogen embrittlement resistance of a steel wire. Among those elements, Nb forms fine precipitates comprising carbide, nitride, sulfide and complex compounds of those, thus enhances hydrogen embrittlement resistance, and moreover exhibits the effects of fine austenite grains and enhancing proof stress and toughness. Meanwhile, V not only forms fine carbide comprising carbide and nitride and thus enhances hydrogen embrittlement resistance, but also exhibits the effect of further improving fatigue properties and moreover the effect of fine austenite grains, thus enhances toughness and proof stress, and contributes also to the improvement of corrosion resistance and sag resistance. Mo forms carbide, nitride, sulfide or complex compounds of those, thus enhances hydrogen embrittlement resistance, moreover improves fatigue properties, and further contributes to the improvement of hydrogen embrittlement resistance and fatigue properties also by enhancing the austenite grain boundary strength. Further, the existence of Mo exhibits the effect of improving corrosion resistance by the adsorption of molybdate ions (Mo42−) generated during corrosion and dissolution.

In order to exhibit those effects, it is preferable that a Nb content is 0.01% or more, still preferably 0.02% or more. However, when a Nb content is excessive, the amount of carbide which is not dissolved in austenite during austenitization heating increases and a prescribed tensile strength cannot be obtained. It is therefore preferable that a Nb content is 0.1% or less, still preferably 0.05% or less.

Further, the effect of V is effectively exhibited when a V content is 0.07% or more. However, when a V content is excessive, the amount of carbide which is not dissolved in austenite during austenitization heating increases, sufficient levels of strength and hardness are hardly obtained, and also the effect of the reduction of a retained austenite amount is hardly obtained. It is therefore preferable that a V content is 0.40% or less, still preferably 0.30% or less.

The effect of Mo is effectively exhibited when a Mo content is 0.10% or more. However, when Mo is contained excessively, not only the effect of Mo is saturated but also the coarsening and the increase of number of carbide, nitride, sulfide or complex compounds of those are caused. It is therefore preferable that a Mo content is 1.0% or less, still preferably 0.50% or less.

[At Least One Kind Selected from Among the Group of W: 0.10-1.0%, Ni: 0.05-1.0% and Cu: 0.05-1.0%]

W, Ni and Cu are elements which effectively act on the improvement of the corrosion resistance of a steel wire. Among those elements, W forms tungstate ions during corrosion and dissolution and contributes to the improvement of corrosion resistance. Meanwhile, Ni not only makes formed rust amorphous and dense and acts on the improvement of corrosion resistance but also exhibits the effect in enhancing the toughness of a material after austenitized and tempered. Further, Cu is an element which is electrochemically nobler than iron and hence has the effect of improving corrosion resistance.

The effects are effectively exhibited when a W content is 0.10% or more. However, when a W content exceeds 1.0%, it badly affects the toughness of a material. Then, in order to exhibit the effects of Ni, it is preferable that Ni is contained by 0.05% or more, still preferably 0.1% or more. However, when Ni is contained in excess of 1.0%, not only hardenability increases and a supercooled structure is likely to be formed after rolling but also the amount of retained γalso increases and the effects of the present invention are not exhibited. Here, a yet preferable lower limit of a Ni content is 0.1% and a yet preferable upper limit thereof is 0.7%.

The effect in improving corrosion resistance by Cu is effectively exhibited when a Cu content is 0.005% or more. However, when a Cu content exceeds 1.0%, the effect in further improving corrosion resistance is not expected and rather there arises fear that the embrittlement of a material is caused by hot-rolling. Here, a preferable lower limit of a Cu content is 0.1% and a preferable upper limit thereof is 0.5%.

[Ti: 0.01 to 0.1%]

Ti is an element effective in improving environmental resistance (hydrogen embrittlement resistance) and, in order to exhibit the effect, it is preferable that Ti is contained by 0.01% or more, still preferably 0.04% or more. However, when Ti is contained excessively, coarse nitride only tends to be precipitated. Hence, the upper limit of a Ti content is set at 0.1%.

In a steel wire according to the present invention, it is necessary to appropriately control the martensitic transformation start temperature of a steel material, the austenite grain size number of prior austenite, the grain boundary share of carbide precipitated along the austenite grain boundaries, the amount of retained austenite after austenitized and tempered, and others. By satisfying those requirements, excellent corrosion resistance is exhibited even when the tensile strength is 2,000 MPa or more. The functions and effects obtained by stipulating those requirements are as follows.

[Martensitic Transformation Start Temperatures $M_{S1}$ to $M_{S4}$ of a Steel Material: 280° C. to 380° C.]

By setting the martensitic transformation start temperature of a steel material at a higher level, it is possible to: raise a martensitic transformation finish temperature; and thus prevent the amount of retained austenite which tends to be formed due to insufficient austenitizing during short-time austenitizing and tempering from increasing during the austenitizing. If the amount of retained austenite at austenitizing can be reduced, it is possible to: reduce the amounts of cementite and carbide precipitated due to the decomposition of the retained austenite at tempering; and thus lead to the improvement of corrosion resistance as stated above. In order to control the amount of retained austenite after austenitized and tempered to a prescribed amount or lower, it is necessary to control a martensitic transformation start temperature ($M_{S1}$ to $M_{S4}$) to 280° C. or higher. However, when a martensitic transformation start temperature exceeds 380° C., the transformation commences before a material enters into the cooling medium of austenitizing, an uneven structure and austenitizing cracks are formed, and productivity may be hindered. A preferable lower limit of a martensitic transformation start temperature is 300° C. and a preferable upper limit thereof is 350° C.

Meanwhile, as a martensitic transformation start temperature, the value calculated with the aforementioned expression (1) may basically be adopted. However, when a steel wire contains elements of the aforementioned (a) and/or (b), some of those elements affect the martensitic transformation start temperature and hence it is necessary to control any of the values $M_{S2}$ to $M_{S4}$ calculated with any of the aforementioned expressions (2) to (4) so as to be in the range from 280° C. to 380° C. in consideration of the contents of those elements.

[Prior Austenite Austenite Grain Size Number N: No. 12 or More]

Toughness, ductility and hydrogen embrittlement resistance are improved by fining the austenite grains. Further, one of the features of the present invention is the improvement of corrosion resistance by the fine austenite grains. That is, if prior austenite crystal grains can be fined, it is possible to finely disperse cementite and carbide precipitated at austenite grain boundaries (prior austenite crystal grain boundaries) during tempering. Corrosion potential difference is likely to be generated between cementite/carbide and a base steel matrix, and thus the corrosion potential difference increases and corrosion may advance as the sizes of the cementite and carbide increase. For that reason, in the present invention, by fractionizing prior austenite crystal grains and finely dispersing cementite and carbide, it is possible to minimize the corrosion potential difference and improve corrosion resistance. Here, an austenite grain size number N is a value defined in conformity with JIS G0551.

[Grain Boundary Share of Carbide Precipitated Along Austenite Grain Boundaries: 50% or Less]

The aforementioned "grain boundary share" means the ratio of the area of the parts of crystal grain boundaries where carbide precipitates to the total grain boundary area.

When carbide (film-like cementite and granular carbide) precipitates at austenite grain boundaries, corrosion proceeds due to local battery action, and corrosion resistance (eventually corrosion fatigue resistance) is deteriorated. Better corrosion resistance is obtained as the share of carbide precipitated at austenite grain boundaries reduces and, since the harmful influence is substantially avoided as far as the grain boundary share is controlled to 50% or less, the grain boundary share is set at 50% or less. A preferable upper limit thereof is 20%.

[Retained Austenite Amount After Austenitized and Tempered: 20 vol. % or Less]

When a retained austenite amount after austenitized increases, the retained austenite decomposes during tempering, thereby carbide (film-like cementite and granular carbide) precipitates in large quantity around grain boundaries, the aforementioned grain boundary share increases, and thereby corrosion resistance deteriorates. For that reason, it is necessary to control a retained austenite amount after austenitized. Here, it can be said that the retained austenite amount after austenitized is in an appropriate range as long as the retained austenite amount is 20 vol. % or less after austenitized and tempered. A preferable upper limit of the retained austenite amount after austenitized and tempered is 15 vol. %.

When such a steel wire as stated above is produced, it is necessary to appropriately control a steel structure and working conditions (cold-drawing conditions) before austenitizing and tempering, austenitizing and tempering conditions after cold-drawing, and others. Then, the reasons for setting those conditions at each of the processes are as follows.

[Steel Structure and Working Conditions Before Austenitizing and Tempering]

By cooling a steel material having such chemical components as stated above from an austenitizing temperature range (a temperature of the Ar3 transformation temperature or higher) after hot-rolled into a shape of a steel wire and thereby controlling the fraction of ferrite and pearlite structures to 40% or more in area percentage and the fraction of martensite and bainite structures to 60% or less in area percentage, a steel material withstanding cold-drawing at a reduction of area of 20% or more can be obtained. In this case, when strength before cold-drawing is high and the cold-drawing is hardly applied, it is also possible to apply the cold-drawing after applying annealing at a temperature of the Ac1 transformation temperature or lower. Further, in order to control a steel structure as stated above, it is only necessary to control a cooling rate to 1.5° C./sec. or less in the temperature range from the A3 transformation temperature to 600° C. after hot-rolling and adopt a steel material of a component type showing low hardenability.

By applying cold-drawing of a reduction of area of 20% or more to a wire rod wherein the steel structure is controlled as stated above, it is possible to increase the strain dislocation density in the steel, accelerate the dissolution of carbide even at a high heating rate of 50° C./sec. or more at the austenitization heating, and thus obtain fine austenite grains.

[Austenitizing and Tempering Conditions After Cold-Drawing]

In order to obtain fine austenite grains, it is only necessary to control a heating rate to 50° C./sec. or more and a austenitization heating time to 90 sec. or less at austenitization heating. Such heating conditions can be obtained by, for example, high-frequency induction heating. A preferable lower limit of a heating rate in this case is 60° C./sec. and a preferable upper limit of a austenitization heating time is 60 sec. It is preferable to control a heating temperature at austenitizing to 880° C. or higher.

Meanwhile, by raising a heating rate at temper heating, it is possible to: suppress the precipitation of cementite onto austenitized prior austenite crystal grain boundaries; apply tempering at a high temperature range from 410° C. to 480° C. since the drop of hardness is not substantial; and thus further improve toughness and ductility. In order to control the share of carbide precipitated along the austenite grain boundaries to 50% or less, it is necessary to control a heating rate to 50° C./sec. or more and a retention time to 60 sec. or less. A preferable heating rate is 60° C./sec. or more and a preferable retention time is 20 sec. or less at tempering. Austenitizing and tempering satisfying above conditions is hereunder referred to as "short-time austenitizing and tempering" occasionally. Here, when a tempering temperature is lower than 410° C., the hardness of a spring largely drops at stress relief annealing after the cold-coiling of the spring and moreover the forming and accuracy of the spring also tend to deteriorate. Further, toughness and ductility also deteriorate. In contrast, when a tempering temperature exceeds 480° C., the amount of carbide precipitated at grain boundaries increases.

[Cooling Medium at Austenitizing]

As a cooling medium used at austenitizing, it is preferable to use water at least around the end of transformation. For example, adopted is either a method of applying austenitizing with oil as a cooling medium at the stage of martensitic transformation start, thereafter applying cooling with water as the cooling medium, and thus completing transformation, or a method of applying austenitizing with only water as a cooling medium from the beginning.

FIG. 1 is a graph (schematic graph) explaining the difference between conventional austenitizing and tempering conditions and the austenitizing and tempering conditions according to the present invention (short-time austenitizing and tempering). That is, in the case of short-time austenitizing and tempering according to the present invention (shown with the lines A and B in the figure), even when tempering is applied at a relatively high temperature (475° C. for example), it is possible to maintain the tensile strength of a steel wire to a prescribed value or more and also maintain the grain boundary share of carbide after austenitized and tempered at a relatively low level. In contrast, in the case of the conventional austenitizing and tempering (shown with the lines C and D in the figure), when the tempering temperature is raised to about 400° C. or higher, the tensile strength of a steel wire after tempered drastically lowers, also the grain boundary share of carbide after austenitized and tempered increases, and resultantly corrosion resistance deteriorates.

The effects of the present invention are hereunder explained more specifically showing examples. However, the present invention is not limited to the examples shown below and modifications in design in conformity with the aforementioned and after-mentioned tenor are all included within the technological scope of the present invention.

EXAMPLES

Steel materials (Nos. A to K) having the chemical component compositions shown in Table 1 below were produced by melting in a small vacuum melting furnace, then forged into square billets of 155 mm on a side, and thereafter hot-rolled into wire rods of 16.0 mm in diameter. Each of the wire rods was drawn to a prescribed diameter and then subjected to austenitizing and tempering in a high-frequency induction heating furnace, and thereby a steel wire for a cold-formed spring (a steel wire for a suspension spring) was produced. Water cooling was adopted as the cooling at the austenitizing and tempering. Table 2 shows the production conditions of the steel wires together with the fractions of the structures before cold-drawing. Here, the fractions of the structures shown in Table 2 were obtained by observing the cross sections of the rolled steel wires at between quarter radius and half-radius depth from the wire surface with an optical microscope and were controlled by changing the cooling rate in the temperature range from the A3 transformation temperature to 600° C. after the rolling.

TABLE 1

| Steel type | Chemical composition (mass %) C | Si | Mn | Ni | Cr | V | Ti | Cu | P | S | Mo | W | Nb | $Ms_1$~$Ms_4$ (° C.) |
|---|---|---|---|---|---|---|---|---|---|---|---|---|---|---|
| A | 0.49 | 2.02 | 0.81 | — | 0.21 | — | — | — | 0.010 | 0.005 | — | — | — | 337.32 |
| B | 0.48 | 2 | 0.8 | — | 1.1 | 0.2 | — | — | 0.006 | 0.007 | — | — | — | 316.52 |
| C | 0.46 | 2.05 | 0.77 | — | 1.08 | — | — | — | 0.012 | 0.009 | 0.32 | — | — | 330.71 |
| D | 0.48 | 1.98 | 0.72 | 0.44 | 0.24 | — | — | 0.22 | 0.015 | 0.013 | — | — | — | 334.16 |
| E | 0.48 | 1.96 | 0.76 | 0.32 | 0.2 | 0.15 | 0.073 | 0.21 | 0.003 | 0.002 | — | — | — | 330.29 |
| F | 0.49 | 1.98 | 0.77 | — | 0.21 | 0.16 | 0.07 | — | 0.008 | 0.008 | — | — | — | 333.28 |
| G | 0.55 | 2.44 | 0.88 | 0.72 | 0.22 | — | 0.065 | 0.41 | 0.009 | 0.010 | — | — | — | 296.39 |
| H | 0.45 | 1.5 | 0.22 | 0.11 | 0.21 | — | 0.077 | — | 0.013 | 0.002 | 0.56 | 0.52 | 0.03 | 367.5 |
| I | 0.66 | 1.75 | 0.81 | 0.08 | 0.2 | 0.121 | — | 0.19 | 0.002 | 0.003 | — | — | 0.02 | 268.66 |
| J | 0.54 | 2.11 | 0.88 | 0.72 | 1.05 | 0.21 | — | 0.2 | 0.005 | 0.008 | 0.39 | — | — | 276.20 |
| K | 0.41 | 1.75 | 0.18 | 0.56 | 1.02 | 0.168 | 0.071 | 0.23 | 0.004 | 0.007 | — | — | — | 356.87 |

TABLE 2

| Steel type | Code | Fraction of structure after rolling (area %) Ferrite | Pearlite | Martensite + bainite | Drawing area reduction ratio (%) | Austenitization heating rate (° C./sec.) | Austenitizing temperature (° C.) | Austenitizing retention time (sec.) | Austenitizing oil temperature (° C.) | Austenitizing water temperature (° C.) | Temper heating rate (° C./sec) | Tempering temperature (° C.) | Tempering retention time (sec.) |
|---|---|---|---|---|---|---|---|---|---|---|---|---|---|
| A | A-1 | 31 | 69 | 0 | 25 | 150 | 900 | 20 | 82 | 50 | 55 | 470 | 41 |
| A | A-2 | 17 | 58 | 25 | 15 | 100 | 900 | 70 | 83 | 48 | 91 | 450 | 30 |
| B | B-1 | 28 | 72 | 0 | 25 | 150 | 900 | 72 | 85 | 50 | 61 | 465 | 40 |
| B | B-2 | 28 | 72 | 0 | 25 | 150 | 900 | 72 | 84 | 48 | 44 | 450 | 70 |
| C | C-1 | 20 | 80 | 0 | 25 | 150 | 900 | 72 | 85 | 45 | 61 | 465 | 40 |
| C | C-2 | 20 | 80 | 0 | 25 | 150 | 900 | 72 | 86 | 48 | 42 | 460 | 75 |
| D | D-1 | 28 | 72 | 0 | 25 | 150 | 900 | 20 | 78 | 51 | 100 | 460 | 10 |
| D | D-2 | 15 | 65 | 20 | 21 | 100 | 920 | 70 | 84 | 52 | 48 | 440 | 63 |
| D | D-3 | 15 | 65 | 20 | 15 | 110 | 950 | 15 | 77 | 65 | 100 | 450 | 10 |
| E | E-1 | 30 | 70 | 0 | 25 | 100 | 900 | 70 | 90 | 51 | 51 | 470 | 45 |
| E | E-2 | 25 | 65 | 10 | 28 | 110 | 910 | 60 | 90 | None | 90 | 470 | 20 |
| E | E-3 | 20 | 60 | 20 | 24 | 40 | 900 | 110 | 85 | 60 | 80 | 475 | 15 |
| E | E-4 | 15 | 20 | 65 | 21 | — | — | — | — | — | — | — | — |
| E | E-5 | 30 | 70 | 0 | 18 | 100 | 890 | 70 | 82 | 52 | 90 | 460 | 30 |
| E | E-6 | 15 | 35 | 50 | 21 | 150 | 880 | 20 | 77 | 51 | 45 | 460 | 65 |
| F | F-1 | 33 | 67 | 0 | 25 | 150 | 880 | 20 | 80 | 65 | 105 | 460 | 10 |
| F | F-2 | 12 | 38 | 50 | 21 | 70 | 900 | 50 | 81 | None | 50 | 450 | 45 |
| F | F-3 | 19 | 51 | 30 | 21 | 48 | 910 | 95 | 79 | 71 | 90 | 460 | 30 |
| F | F-4 | 33 | 67 | 0 | 15 | 150 | 920 | 30 | 80 | 73 | 70 | 460 | 38 |
| G | G-1 | 15 | 85 | 0 | 25 | 50 | 900 | 90 | 90 | 50 | 75 | 420 | 39 |
| G | G-2 | 2 | 28 | 70 | 21 | — | — | — | — | — | — | — | — |
| G | G-3 | 10 | 80 | 10 | 18 | 150 | 900 | 20 | 91 | 51 | 70 | 450 | 38 |
| H | H-1 | 30 | 70 | 0 | 25 | 70 | 920 | 40 | 66 | 62 | 50 | 460 | 45 |
| H | H-2 | 9 | 27 | 64 | 20 | — | — | — | — | — | — | — | — |
| H | H-3 | 20 | 60 | 20 | 18 | 150 | 910 | 30 | 72 | 65 | 65 | 470 | 50 |
| I | I-1 | 5 | 95 | 0 | 25 | 70 | 980 | 50 | 72 | 66 | 100 | 470 | 10 |
| J | J-1 | 4 | 41 | 55 | 20 | 80 | 950 | 40 | 77 | 48 | 95 | 460 | 15 |
| K | K-1 | 31 | 69 | 0 | 25 | 91 | 900 | 45 | 71 | 41 | 105 | 420 | 10 |

Each of the austenitized and tempered steel wires was embedded into resin, thereafter the cross sectional plane thereof was subjected to polishing and mirror finishing, and the retained austenite amount was measured with an X-ray diffractometer. Further, a JIS Z2201 No. 2 tensile test piece was sampled from each of the austenitized and tempered steel wires and the austenite grain size number thereof was measured (JIS G0551) at quarter-radius depth from the surface of wire. Furthermore, corrosion test pieces and rotating-bending fatigue test in corrosion pieces were produced by machining and subjected to corrosion tests and rotating-bending fatigue test in corrosions through the procedures shown below. In addition, tensile tests were applied and tensile strength TS and reduction of area after fracture RA were measured, and the share of carbide precipitated at austenite grain boundaries (carbide share) was also measured by the method shown below.

[Corrosion Test]

Each of the test pieces was subjected to a test of 14 cycles each of which comprised the processes of applying salt spraying of 5% NaCl aqueous solution at 35° C. for eight hours and thereafter retaining for sixteen hours at 35° C. in 60% relative humidity environment, and corrosion weight loss was measured by the weight difference of the test piece between before and after the test and also corrosion pit depth was measured with a laser microscope.

[Rotating-Bending Fatigue Test in Corrosion]

A JIS Z2274 No. 1 test piece was prepared as a rotating-bending fatigue test in corrosion piece and subjected to an Ono-type rotating-bending fatigue tester at a rotation speed of 60 rpm and under the stress of 200 MPa while dropping 5% NaCl aqueous solution onto the test piece at 0.2 L/min circulated flow, and the number of cycles up to the time when the test piece fractured (cycles up to fracture) was measured.

[Carbide Share]

The share (area percentage) of carbide at austenite crystal grain boundaries was measured through the following procedures:

(1) A test piece was subjected to Charpy impact test at −50° C. and a fractured surface containing an intergranular fractured surface was revealed. As the Charpy impact test piece, a JIS No. 3 sub-size test piece of U-notched type was adopted and the width thereof was 5.5 mm. Here, the size of the Charpy impact test piece does not necessarily conform to JIS and, in the case of a thin steel wire, the height may be 10 mm or less as long as a test piece can be cut out from a austenitized and tempered steel wire. It is only necessary to obtain an intergranular fractured surface at the Charpy impact test.

(2) The fractured surface was etched by electrolytic corrosion. In the electrolytic etching, 10% acetylacetone—1% tetra-methylammonium chloride—methanol was used as the electrolyte and the electrolytic potential and the electrolytic charge were set at −100 $mV_{SCE}$ and 0.13 to 0.15 Coulomb/$cm^2$, respectively.

(3) A photograph of an intergranular fractured portion was taken with an electron microscope. In this case, an intergranular fractured surface after etched was observed at an accelerating voltage of 15 kV with a high-resolution scanning electron microscope.

(4) The photographic image was binarized with an image processor, the parts of carbide were extracted, and the area percentage (share) of the carbide parts on the intergranular fractured surface was measured. A photograph taken at a magnification of 10,000 was used for the measurement of the share. The area percentage was measured in the area of 30 $\mu m^2$ or more per grain boundary and at ten grain boundaries (position: at the center axis of the test piece; depth: 4 mm from the bottom of the notch; interval: 10 μm). Note that, since Fe parts are corroded in the case of electrolytic corrosion, the carbide takes on feathery, tabular and granular shapes.

Those results are collectively shown in Table 3 below. Here, in order to evaluate the amount of retained austenite as austenitized (before tempered), the measurement results of retained austenite amounts of steel wires after water-austenitized (steel wires not subjected to tempering) are shown together.

TABLE 3

| Steel type | Code | Prior austenite austenite grain size number N | Retained austenite amount as austenitized (vol. %) | Retained austenite amount after austenitized and tempered (vol. %) | Carbide share at austenite grain boundaries (%) | TS (Mpa) | RA (%) | Corrosion weight loss at corrosion test ($g/m^2$) | Cycles up to fracture at rotating-bending fatigue test in corrosion (frequency) |
|---|---|---|---|---|---|---|---|---|---|
| A | A-1 | 12.8 | 19.8 | 13.4 | 17 | 2010 | 45 | 589 | 679200 |
| A | A-2 | 11.1 | 21.5 | 14.2 | 18 | 2025 | 44 | 956 | 57200 |
| B | B-1 | 12.9 | 22.0 | 14.3 | 18 | 2095 | 45 | 587 | 652100 |
| B | B-2 | 12.3 | 22.8 | 15.6 | 58 | 2080 | 46 | 987 | 47100 |
| C | C-1 | 12.5 | 19.0 | 12.3 | 19 | 2005 | 42 | 622 | 689200 |
| C | C-2 | 12.4 | 12.0 | 9.8 | 56 | 2020 | 41 | 822 | 55600 |
| D | D-1 | 13.1 | 18.5 | 15.1 | 34 | 2105 | 48 | 662 | 868900 |
| D | D-2 | 12.25 | 22.0 | 16.2 | 54 | 2098 | 45 | 954 | 62200 |
| D | D-3 | 11.5 | 24.2 | 18.1 | 33 | 2120 | 49 | 865 | 59400 |
| E | E-1 | 13.2 | 15.0 | 13.1 | 19 | 2065 | 48 | 655 | 568100 |
| E | E-2 | 14.1 | 28.5 | 21.5 | 64 | 2060 | 51 | 1251 | 11560 |
| E | E-3 | 11.5 | 22.3 | 18.5 | 32 | 2051 | 47 | 796 | 255200 |
| E | E-4 | — | — | — | — | — | — | — | — |
| E | E-5 | 11.8 | 18.5 | 14.5 | 28 | 2100 | 47 | 861 | 189800 |
| E | E-6 | 13.3 | 19.6 | 17.2 | 64 | 2095 | 46 | 1085 | 26100 |
| F | F-1 | 13.4 | 13.4 | 11.5 | 12 | 2070 | 49 | 505 | 921500 |
| F | F-2 | 12.58 | 26.0 | 22.8 | 52 | 2100 | 53 | 1024 | 83300 |
| F | F-3 | 11.5 | 18.9 | 13.4 | 18 | 2065 | 50 | 1051 | 15100 |
| F | F-4 | 11.4 | 14.7 | 12.1 | 19 | 2120 | 42 | 988 | 58900 |
| G | G-1 | 12.8 | 21.8 | 18.5 | 43 | 2190 | 38 | 724 | 276600 |
| G | G-2 | — | — | — | — | — | — | — | — |
| G | G-3 | 11.8 | 19.0 | 17.3 | 38 | 2150 | 45 | 964 | 85000 |
| H | H-1 | 13.2 | 16.8 | 12 | 11 | 2050 | 41 | 491 | 986500 |
| H | H-2 | — | — | — | — | — | — | — | — |
| H | H-3 | 11.6 | 12.5 | 9.8 | 5 | 2020 | 46 | 885 | 55620 |
| I | I-1 | 12.8 | 28.9 | 22.1 | 71 | 2210 | 45 | 1256 | 46200 |
| J | J-1 | 12.84 | 29.6 | 25.1 | 68 | 2120 | 44 | 1122 | 36400 |
| K | K-1 | 13.4 | 11.0 | 9.2 | 4 | 1854 | 48 | 470 | 221500 |

From those results, the following discussions arise. Firstly, it is understood that the cases of A-1, B-1, C-1, D-1, E-1, F-1, G-1, and H-1 are the examples satisfying the requirements stipulated in the present invention and, in any of the cases, a high tensile strength TS of 2,000 MPa or more and excellent corrosion resistance are exhibited.

On the other hand, the other cases are the examples which do not satisfy at least one of the requirements stipulated in the present invention and hence at least one of the characteristics is inferior. Firstly, in the case of A-2, the reduction of area at cold-drawing is small, the austenite grain size number N is small (namely the crystal grains are large), and resultantly corrosion resistance deteriorates. In any of the cases of B-2, C-2, and D-2, the heating rate at tempering is low, the carbide share is large, and resultantly corrosion resistance deteriorates.

In the case of D-3, the reduction of area at cold-drawing is small, the austenite grain size number N is small (namely the crystal grains are large), and resultantly corrosion resistance deteriorates.

In the case of E-2, water austenitizing was not applied, thus the retained austenite amount is large, the carbide share is large, and resultantly corrosion resistance deteriorates. In the case of E-3, the austenitizing conditions (the austenitization heating rate and the retention time of heating) deviate from the ranges stipulated in the present invention, the austenite grain size number N is small (namely the crystal grains are large), and resultantly corrosion resistance deteriorates. In the case of E-4, the fractions of the structures after rolling deviate from the ranges stipulated in the present invention, and thus good drawing was not attained (the succeeding tests were not applied).

In the case of E-5, the reduction of area at cold-drawing is small, the austenite grain size number N is small (namely the crystal grains are large), and resultantly corrosion resistance deteriorates. In the case of E-6, the heating rate at tempering is low, the carbide share is large, and resultantly corrosion resistance deteriorates.

In the case of F-2, water austenitizing was not applied, thus the retained austenite amount is large, the carbide share is large, and resultantly corrosion resistance deteriorates. In the case of F-3, the austenitizing conditions (the austenitization heating rate and the retention time of heating) deviate from the ranges stipulated in the present invention, the austenite grain size number N is small (namely the crystal grains are large), and resultantly corrosion resistance deteriorates. In the case of F-4, the reduction of area at cold-drawing is small, the austenite grain size number N is small (namely the crystal grains are large), and resultantly corrosion resistance deteriorates.

In the case of G-2, the fractions of the structures after rolling deviate from the ranges stipulated in the present invention, and thus good drawing was not attained (the succeeding tests were not applied). In the case of G-3, the reduction of area at cold-drawing is small, the austenite grain size number N is small (namely the crystal grains are large), and resultantly corrosion resistance deteriorates.

In the case of H-2, the fractions of the structures after rolling deviate from the ranges stipulated in the present invention, and thus good drawing was not attained (the succeeding tests were not applied). In the case of H-3, the reduction of area at cold-drawing is small, the austenite grain size number N is small (namely the crystal grains are large), and resultantly corrosion resistance deteriorates.

In the case of I-1, the chemical components and $M_{S4}$ deviate from the ranges stipulated in the present invention (the steel type I in Table 1) and, in the case J-1, $M_{S4}$ deviates from the range stipulated in the present invention (the steel type J in Table 1). Hence, in any of the cases, the retained austenite amount is large, the carbide share is large, and resultantly corrosion resistance deteriorates.

In the case of K-1, a chemical component deviates from the range stipulated in the present invention (the steel type K in Table 1), and resultantly the tensile strength lowers.

Figure 2:
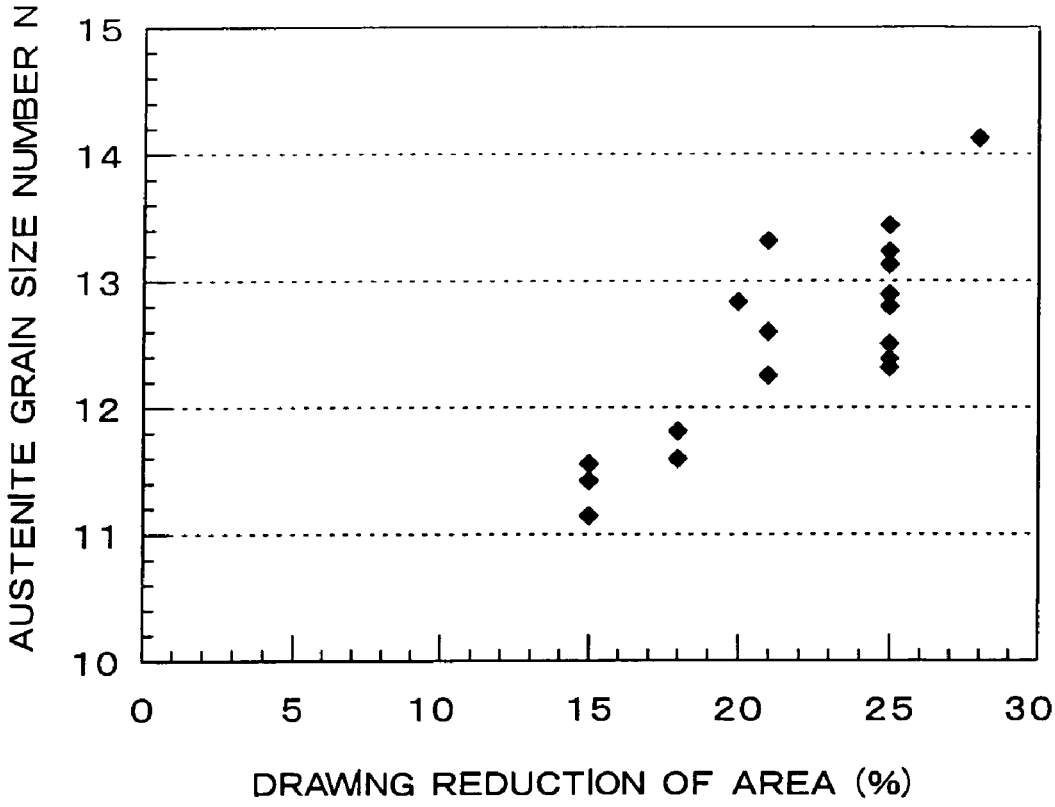
FIG. 2 is a graph showing the relationship between a drawing reduction of area and an austenite grain size number N.

FIG. 2 shows the relationship between a drawing reduction of area and an austenite grain size number N on the basis of the above results. From the figure, it is understood that it is possible to control the austenite grain size number N to 12 or more by controlling the drawing area reduction ratio to 20% or more.

Figure 3:
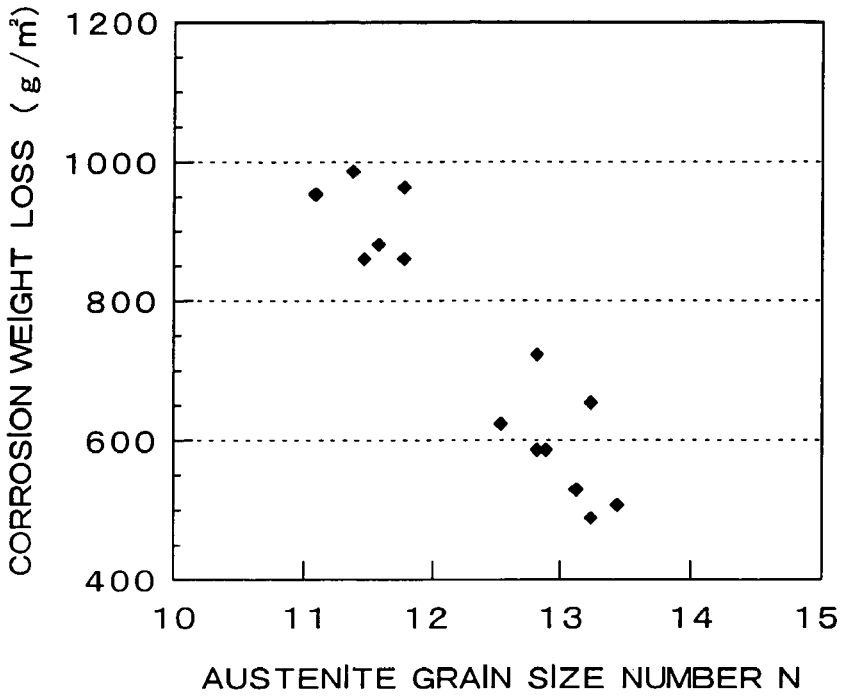
FIG. 3 is a graph showing the relationship between an austenite grain size number N and a corrosion weight loss.

FIG. 3 shows the relationship between an austenite grain size number N and a corrosion weight loss. From the figure, it is understood that it is possible to reduce the corrosion weight loss and exhibit good corrosion resistance by controlling the austenite grain size number N to 12 or more.

Figure 4:
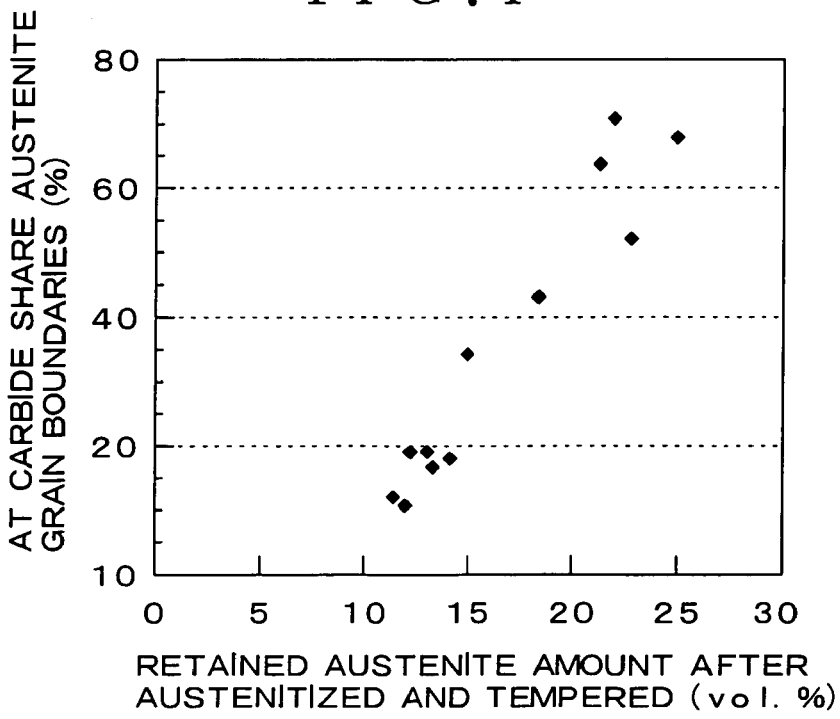
FIG. 4 is a graph showing the relationship between a retained austenite amount after austenitized and tempered and a carbide share.

FIG. 4 shows the relationship between a retained austenite amount after austenitized and tempered and a carbide share. From the figure, it is understood that it is possible to control the carbide share to 50% or less by controlling the retained austenite amount to 20% or less in area percentage.

Figure 5:
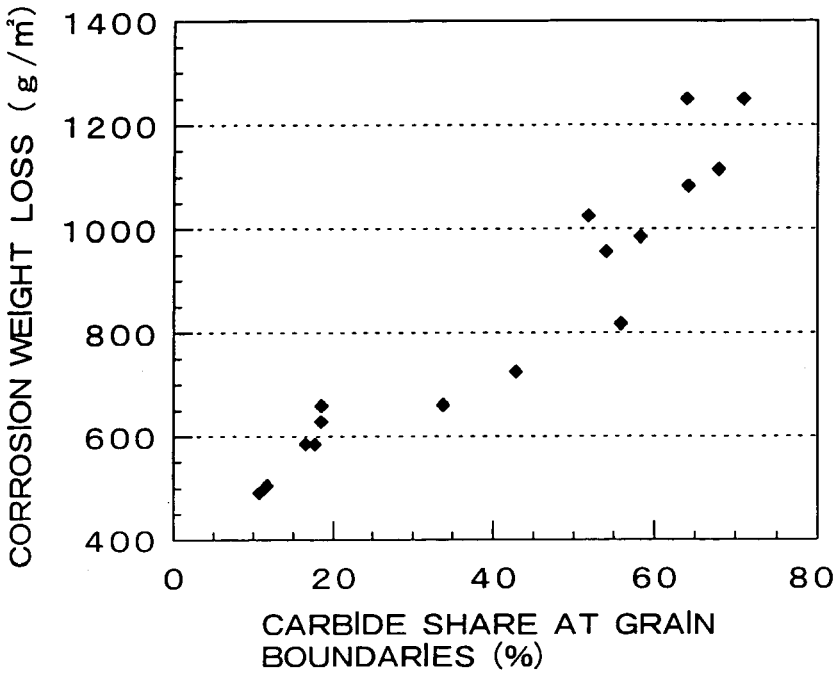
FIG. 5 is a graph showing the relationship between a carbide share and a corrosion weight loss.

FIG. 5 shows the relationship between a carbide share and a corrosion weight loss. From the figure, it is understood that it is possible to reduce the corrosion weight loss and exhibit good corrosion resistance by controlling the carbide share to 50% or less.

Figure 6:
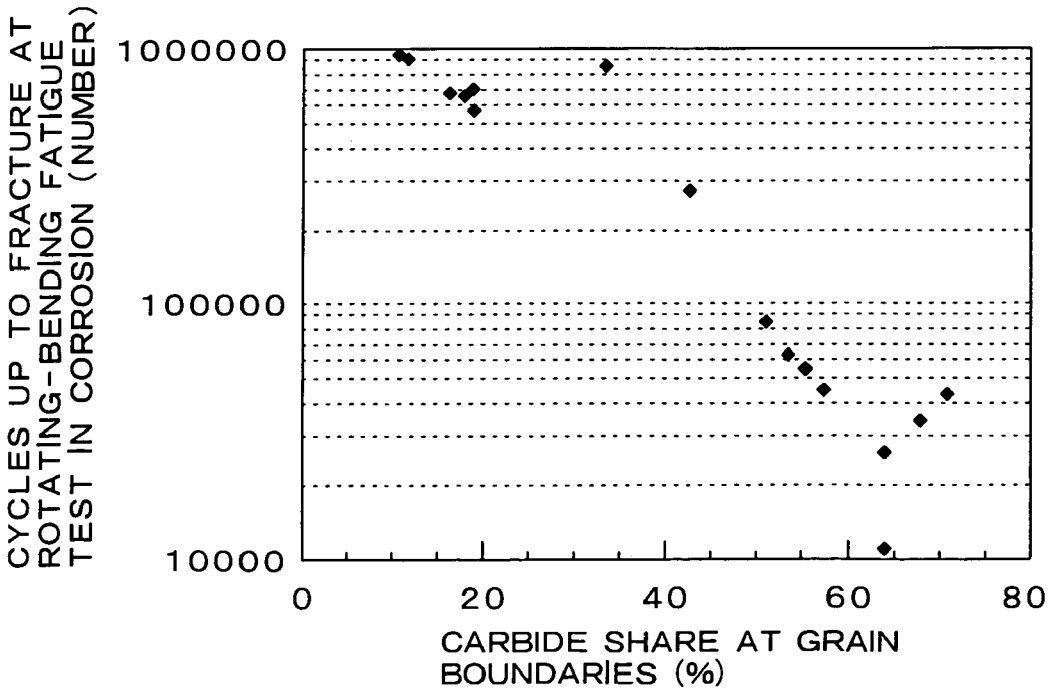
FIG. 6 is a graph showing the relationship between a carbide share and a rotating-bending fatigue test in corrosion (cycles up to fracture).

FIG. 6 shows the relationship between a carbide share and a rotating-bending fatigue test in corrosion (cycles up to fracture). From the figure, it is understood that the cycles up to fracture increases by controlling the carbide share to 50% or less.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A steel wire for a spring containing C: 0.45-0.54% (mass %, the same is applied hereunder), Si: 1.8-2.5%, Mn: 0.05-0.9% and Cr: 0.05-2.0%, comprising a fraction of martensite and bainite of 60% or less in area percentage, wherein P and S are controlled to 0.020% or less (including 0%), respectively;

a martensitic transformation start temperature $M_{S1}$, shown by the following expression (1), is in the range from 280° C. to 380° C., where $$M_{S1}=550-361[C]-39[Mn]-20[Cr] \quad (1), \text{ and}$$

[C], [Mn] and [Cr] represent the contents (mass %) of C, Mn and Cr, respectively; and the steel wire has been austenized and tempered such that the prior austenite grain size number N of austenite grains is No. 12 or more, the grain boundary share of carbide precipitated along the austenite grain boundaries is 50% or less, the amount of retained austenite is 20 vol. % or less, and the tensile strength is 2,000 MPa or more.

2. A steel wire for a spring containing C: 0.45-0.54%, Si: 1.8-2.5%, Mn: 0.05-0.9%, Cr: 0.05-2.0%, and at least one kind selected from among the group of Nb: 0.01-0.10%, V: 0.07-0.40% and Mo: 0.10-1.0%, comprising a fraction of martensite and bainite of 60% or less in area percentage, wherein P and S are controlled to 0.020% or less (including 0%), respectively;

a martensitic transformation start temperature $M_{s2}$, shown by the following expression (2), is in the range from 280° C. to 380° C., where $$M_{S2}=550-361[C]-39[Mn]-20[Cr]-35[V]-5[Mo] \quad (2), \text{ and}$$

[C], [Mn], [Cr], [V] and [Mo] represent the contents (mass %) of C, Mn, Cr, V and Mo, respectively; and the steel wire has been austenized and tempered such that the prior austenite grain size number N of austenite grains is No. 12 or more, the grain boundary share of carbide precipitated along the austenite grain boundaries is 50% or less, the amount of retained austenite is 20 vol. % or less, and the tensile strength is 2,000 MPa or more.

3. A steel wire for a spring containing C: 0.45-0.54%, Si: 1.8-2.5%, Mn: 0.05-0.9%, Cr: 0.05-2.0%, and at least one kind selected from among the group of Ni: 0.05-1.0%, Cu: 0.05-1.0% and W: 0.10-1.0%, comprising a fraction of martensite and bainite of 60% or less in area percentage, wherein P and S are controlled to 0.020% or less (including 0%), respectively;

a martensitic transformation start temperature $M_{S3}$, shown by the following expression (3), is in the range from 280° C. to 380° C., where $$M_{S3}=550-361[C]-39[Mn]-20[Cr]-17[Ni]-10[Cu]-5[W] \quad (3), \text{ and}$$

[C], [Mn], [Cr], [Ni], [Cu] and [W] represent the contents (mass %) of C, Mn, Cr, Ni, Cu and, respectively; and the steel wire has been austenized and tempered such that the prior austenite grain size number N of austenite grains is No. 12 or more, the grain boundary share of carbide precipitated along the austenite grain boundaries is 50% or less, the amount of retained austenite is 20 vol. % or less, and the tensile strength is 2,000 MPa or more.

4. A steel wire for a spring containing C: 0.45-0.54%, Si: 1.8-2.5%, Mn: 0.05-0.9%, Cr: 0.05-2.0%, at least one kind selected from among the group of Nb: 0.01-0.10%, V: 0.07-0.40% and Mo: 0.10-1.0%, and at least one kind selected from among the group of Ni: 0.05-1.0%, Cu: 0.05-1.0% and W: 0.10- 1.0%, comprising a fraction of martensite and bainite of 60% or less in area percentage, wherein P and S are controlled to 0.020% or less (including 0%), respectively;

a martensitic transformation start temperature $M_{S4}$, shown by the following expression (4), is in the range from 280° C. to 380° C., where $$M_{S4}=550-361[C]-39[Mn]-20[Cr]-35[V]-5[Mo]-17[Ni]-10[Cu]-5[W] \quad (4),$$

and

[C], [Mn], [Cr], [V], [Mo], [Ni], [Cu] and [W] represent the contents (mass %) of C, Mn, Cr, V, Mo, Ni, Cu and, respectively; and the steel wire has been austenized and tempered such that the prior austenite grain size number N of austenite grains is No. 12 or more, the grain boundary share of carbide precipitated along the austenite grain boundaries is 50% or less, the amount of retained austenite is 20 vol. % or less, and the tensile strength is 2,000 MPa or more.

5. The steel wire for a spring according to claim 1, further containing Ti: 0.01-0.1%.

6. A method for producing a steel wire for a spring according to claim 1, comprising the processes of:

hot-rolling into a shape of a wire rod a steel containing C: 0.45- 0.54%, Si: 1.8-2.5%, Mn: 0.05-0.9% and Cr: 0.05-2.0%, where P and S are controlled to 0.020% or less (including 0%), respectively;

cooling said hot-rolled wire rod steel from the austenitizing temperature range, and thereby controlling the fraction of ferrite and pearlite structures to 40% or more in area percentage and the fraction of a structure comprising martensite and bainite to 60% or less in area percentage;

applying cold-drawing to the steel having the structures of aforementioned fractions at a reduction of area of 20% or more; and applying an austenitizing process and a tempering process to the steel subjected to said cold-drawing, wherein said steel is heated to a prescribed temperature at a heating rate of 50° C./sec. or higher and thereafter retained for 90 sec. or less at said prescribed temperature followed by cooling in a cooling medium in said austenitizing process, and retained for 60 sec. or less at a tempering temperature in the range from 410° C. to 480° C. in said tempering process.

7. A method for producing a steel wire for a spring according to claim 6, wherein oil and water or only water are/is used as a cooling medium in said austenitizing process.

8. The steel wire for a spring according to claim 1, wherein the steel wire is obtained by a process comprising hot rolling followed by cooling the steel at a cooling rate of 1.5° C./sec or less in a temperature range of from a A3 transformation temperature to 600° C.

9. The steel wire for a spring according to claim 2, wherein the steel wire is obtained by a process comprising hot rolling followed by cooling the steel at a cooling rate of 1.5° C./sec or less in a temperature range of from a A3 transformation temperature to 600° C.

10. The steel wire for a spring according to claim 3, wherein the steel wire is obtained by a process comprising hot rolling followed by cooling the steel at a cooling rate of 1.5° C./sec or less in a temperature range of from a A3 transformation temperature to 600° C.

11. The steel wire for a spring according to claim 4, wherein the steel wire is obtained by a process comprising hot rolling followed by cooling the steel at a cooling rate of 1.5° C./sec or less in a temperature range of from a A3 transformation temperature to 600° C.

12. The steel wire for a spring according to claim 1, wherein the steel wire has the fraction of martensite and bainite of from 0 to 55% in area percentage.

* * * * *